US011248867B2

(12) United States Patent
Lee et al.

(10) Patent No.: US 11,248,867 B2
(45) Date of Patent: Feb. 15, 2022

(54) MODULAR MAGAZINE RELEASE FOR FIREARMS

(71) Applicant: Strike Industries, Inc., Santa Ana, CA (US)

(72) Inventors: Shanyao Lee, Santa Ana, CA (US); Shih-Ting Hung, Taoyuan (TW)

(73) Assignee: Strike Industries, Inc., Santa Ana, CA (US)

( * ) Notice: Subject to any disclaimer, the term of this patent is extended or adjusted under 35 U.S.C. 154(b) by 0 days.

(21) Appl. No.: 16/924,155

(22) Filed: Jul. 8, 2020

(65) Prior Publication Data

US 2022/0011064 A1 Jan. 13, 2022

(51) Int. Cl.

| | |
|---|---|
| ***F41A 17/38*** | (2006.01) |
| ***F41A 35/06*** | (2006.01) |
| *F41A 3/66* | (2006.01) |
| *F41A 9/59* | (2006.01) |

(52) U.S. Cl.

CPC ..... *F41A 17/38* (2013.01); *F41A 35/06* (2013.01); *F41A 3/66* (2013.01); *F41A 9/59* (2013.01)

(58) Field of Classification Search

CPC ..... F41A 9/24; F41A 9/25; F41A 9/59

See application file for complete search history.

(56) References Cited

U.S. PATENT DOCUMENTS

| | | | | | |
|---|---|---|---|---|---|
| 4,429,479 | A * | 2/1984 | Johnson | F41A 17/38 | 42/6 |
| 4,521,985 | A * | 6/1985 | Smith | F41A 35/06 | 42/7 |
| 4,615,134 | A * | 10/1986 | Beretta | F41A 35/06 | 42/6 |
| 4,713,902 | A * | 12/1987 | Wigton | F41A 35/06 | 42/7 |
| 5,519,954 | A * | 5/1996 | Garrett | F41A 17/38 | 42/6 |
| 7,958,661 | B2 * | 6/2011 | Strayer | F41A 35/06 | 42/50 |
| 8,112,926 | B2 * | 2/2012 | Beretta | F41A 17/38 | 42/7 |
| 8,276,502 | B1 * | 10/2012 | Wright | F41A 17/64 | 89/148 |
| 8,713,832 | B2 * | 5/2014 | Troy | F41A 9/25 | 42/6 |
| 8,806,790 | B1 * | 8/2014 | Huang | F41A 17/74 | 42/70.08 |
| 8,925,229 | B2 * | 1/2015 | Michel | F41A 17/38 | 42/6 |

(Continued)

*Primary Examiner* — Derrick R Morgan

(74) *Attorney, Agent, or Firm* — Han IP PLLC; Andy M. Han

(57) ABSTRACT

A device implementable on a firearm includes a magazine release having a magazine catch and a magazine release button coupled to the magazine catch. When the magazine release is installed on the firearm, the magazine catch is configured to hold a magazine in a magazine well of the firearm when the magazine release button is not pressed and the magazine catch is configured to release the magazine from the magazine well when the magazine release button is pressed. The magazine release button includes a coupler configured to couple the magazine release button to the magazine catch. The magazine release button also includes a detachable pedal slidingly attachable to the coupler.

9 Claims, 5 Drawing Sheets

(56) References Cited

U.S. PATENT DOCUMENTS

| | | | | |
|---|---|---|---|---|
| 8,943,866 | B2 * | 2/2015 | Fernandez | F41A 17/42 70/232 |
| 9,010,004 | B1 * | 4/2015 | Fu | F41A 17/38 42/6 |
| 9,121,651 | B1 * | 9/2015 | Jen | F41A 17/38 |
| 10,151,548 | B2 * | 12/2018 | Cross | F41A 17/38 |
| 10,161,701 | B2 * | 12/2018 | Paquette | F41A 35/06 |
| 10,267,584 | B2 * | 4/2019 | Kasanjian-King | F41A 11/00 |
| 10,378,840 | B1 * | 8/2019 | Huang | F41A 9/59 |
| 10,619,960 | B2 * | 4/2020 | Cross | F41A 17/38 |
| 10,690,426 | B1 * | 6/2020 | Huang | F41A 35/00 |
| 10,753,696 | B1 * | 8/2020 | Christopher | F41A 17/36 |
| 10,775,120 | B2 * | 9/2020 | Harris | F41A 17/36 |
| 2013/0014416 | A1 * | 1/2013 | Sisgold | F41A 9/66 42/1.02 |
| 2013/0152442 | A1 * | 6/2013 | Underwood | F41A 9/59 42/6 |
| 2013/0269232 | A1 * | 10/2013 | Harris | F41A 17/38 42/49.01 |
| 2017/0160026 | A1 * | 6/2017 | Walther | F41A 3/68 |
| 2018/0224239 | A1 * | 8/2018 | Noonan | F41C 23/22 |
| 2018/0231341 | A1 * | 8/2018 | Chang | F41A 17/36 |
| 2018/0372441 | A1 * | 12/2018 | Zheng | F41A 35/06 |
| 2019/0078850 | A1 * | 3/2019 | Cross | F41A 17/38 |
| 2020/0011627 | A1 * | 1/2020 | Trease | F41A 11/00 |
| 2020/0263944 | A1 * | 8/2020 | Harris | F41A 17/36 |

* cited by examiner

MODULAR MAGAZINE RELEASE FOR FIREARMS

TECHNICAL FIELD

The present disclosure is generally related to firearm accessories and, more particularly, to a modular magazine release for firearms.

BACKGROUND

Unless otherwise indicated herein, approaches described in this section are not prior art to the claims listed below and are not admitted as prior art by inclusion in this section.

On certain types of firearms (e.g., firearms based on an AR platform such as AR15-styled or AR10-styled rifles, carbines, pistols and shotguns), a magazine release is a device used by a user to release a magazine from a magazine well of the firearm. Specifically, when a magazine release button on one side of a lower receiver of the firearm is pressed, the magazine release button pushes a spring-loaded magazine catch toward the other side of the lower receiver to unlatch the magazine from the magazine catch, thereby releasing the magazine.

As presently a mil-spec magazine release button tends to be small in size, customization of the magazine release typically involves replacing the mil-spec magazine release button with one that is larger in size and/or one with a different shape. However, as a mil-spec magazine release button is typically coupled to the magazine catch by a screw, customization of the magazine release button would require the use of a screwdriver (or a similar tool) to uninstall the incumbent magazine release button and install the new magazine release button, and this tends to be time consuming and may risk scratching and/or blemishing of one or more parts (e.g., lower receiver) of the firearm caused by unintentional contact by the tool. Therefore, there is a need for a solution that allows quick and tool-less customization of the magazine release button.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

In view of the aforementioned issues, an objective of the present disclosure is to propose an innovative design of a modular magazine release. It is believed that the proposed design can avoid or otherwise minimize aforementioned issues associated with conventional magazine releases. For instance, once a modular magazine release in accordance with the present disclosure is installed on a firearm, customization involving the change of color, size, style, shape and/or surface texture of the pedal of the magazine release would not require removal or replacement of the magazine release entirely. Moreover, customization of the pedal of the modular magazine release would not require any tool and, hence, the risk of scratching and/or blemishing of one or more parts (e.g., lower receiver) of the firearm caused by unintentional contact by a tool may be avoided.

In one aspect, a device implementable on a firearm based on an AR platform (e.g., AR15 platform or AR10 platform) may include a magazine release button configured to be coupled to a magazine catch of the firearm. The magazine release button may include a coupler configured to couple the magazine release button to the magazine catch. The magazine release button may also include a detachable pedal slidingly attachable to the coupler.

In another aspect, a device implementable on a firearm based on an AR platform (e.g., AR15 platform or AR10 platform) may include a magazine release. The magazine release may include a magazine catch and a magazine release button coupled to the magazine catch. When the magazine release is installed on the firearm, the magazine catch may be configured to hold a magazine in a magazine well of the firearm when the magazine release button is not pressed. Moreover, the magazine catch may be configured to release the magazine from the magazine well when the magazine release button is pressed. The magazine release button may include a coupler configured to couple the magazine release button to the magazine catch. The magazine release button may also include a detachable pedal slidingly attachable to the coupler.

BRIEF DESCRIPTION OF THE DRAWINGS

The accompanying drawings are included to provide a further understanding of the disclosure and are incorporated in and constitute a part of the present disclosure. The drawings illustrate implementations of the disclosure and, together with the description, explain the principles of the disclosure. It is appreciable that the drawings are not necessarily in scale as some components may be shown to be out of proportion than the size in actual implementation to clearly illustrate the concept of the present disclosure.

DETAILED DESCRIPTION OF PREFERRED IMPLEMENTATIONS

Figure 1:
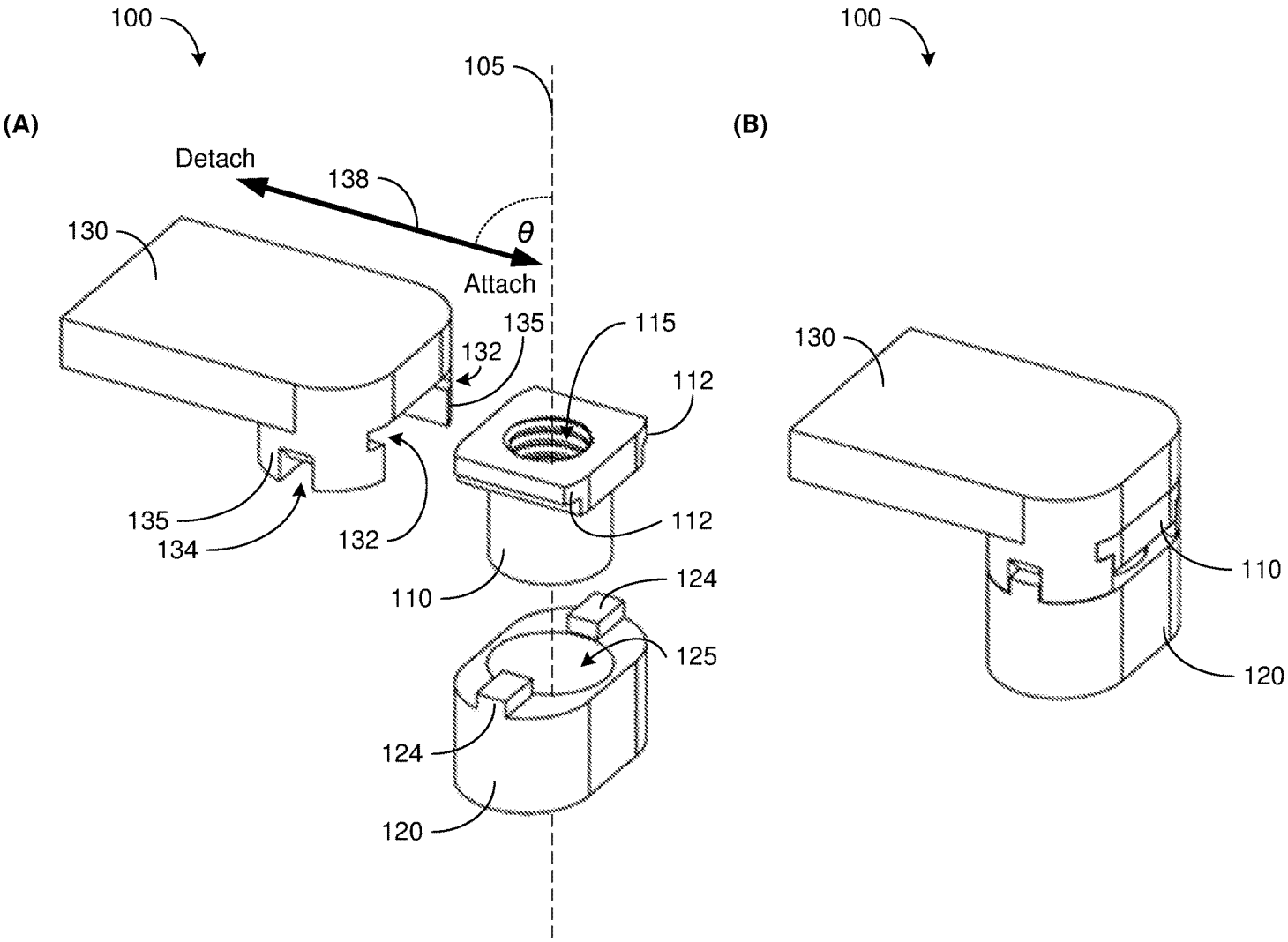
FIG. 1 is a diagram of a device in accordance with an implementation of the present disclosure.
Figure 2:
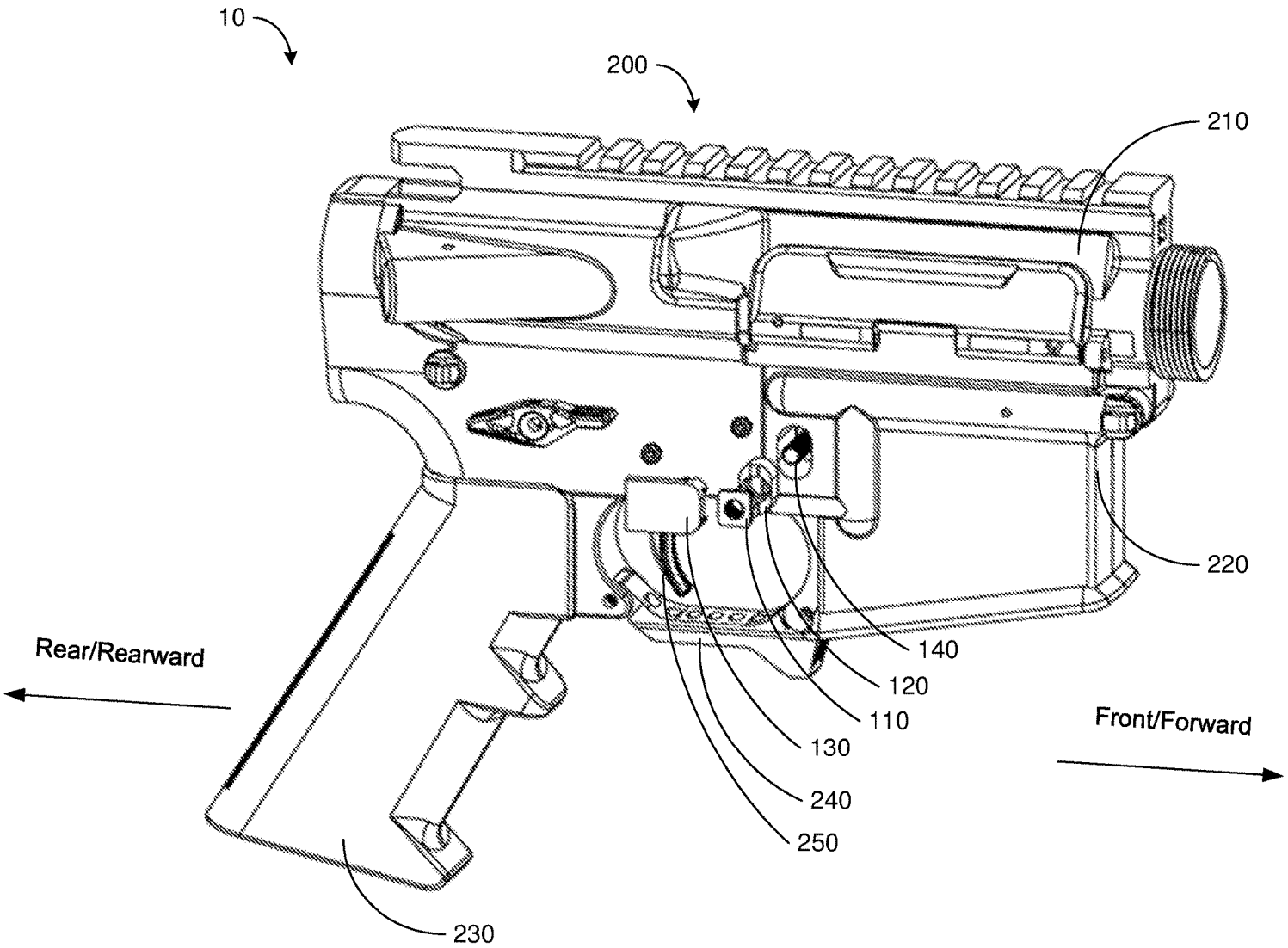
FIG. 2 is a diagram of an example implementation in accordance with an implementation of the present disclosure.
Figure 3:
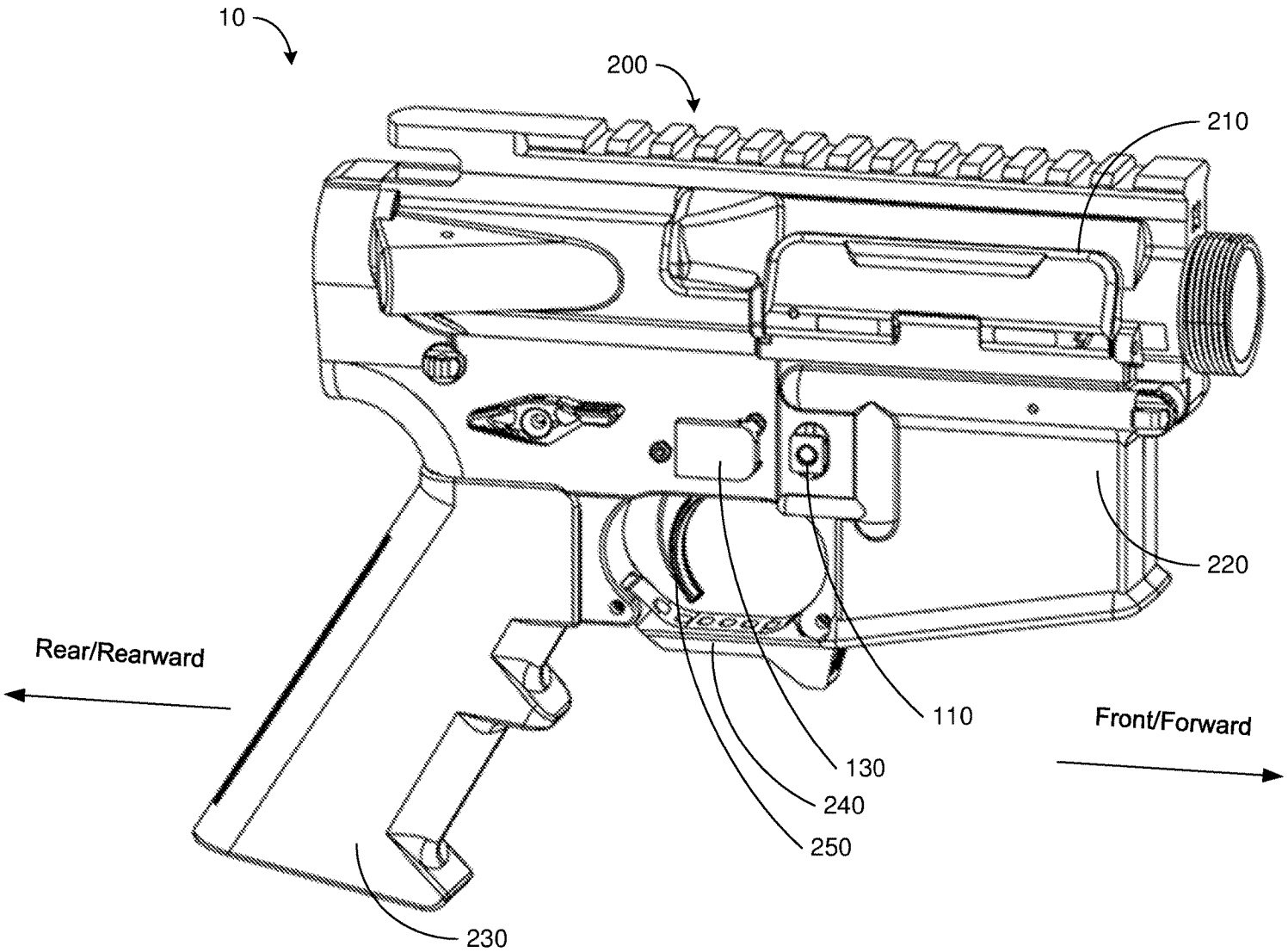
FIG. 3 is a diagram of an example implementation in accordance with an implementation of the present disclosure.
Figure 4:
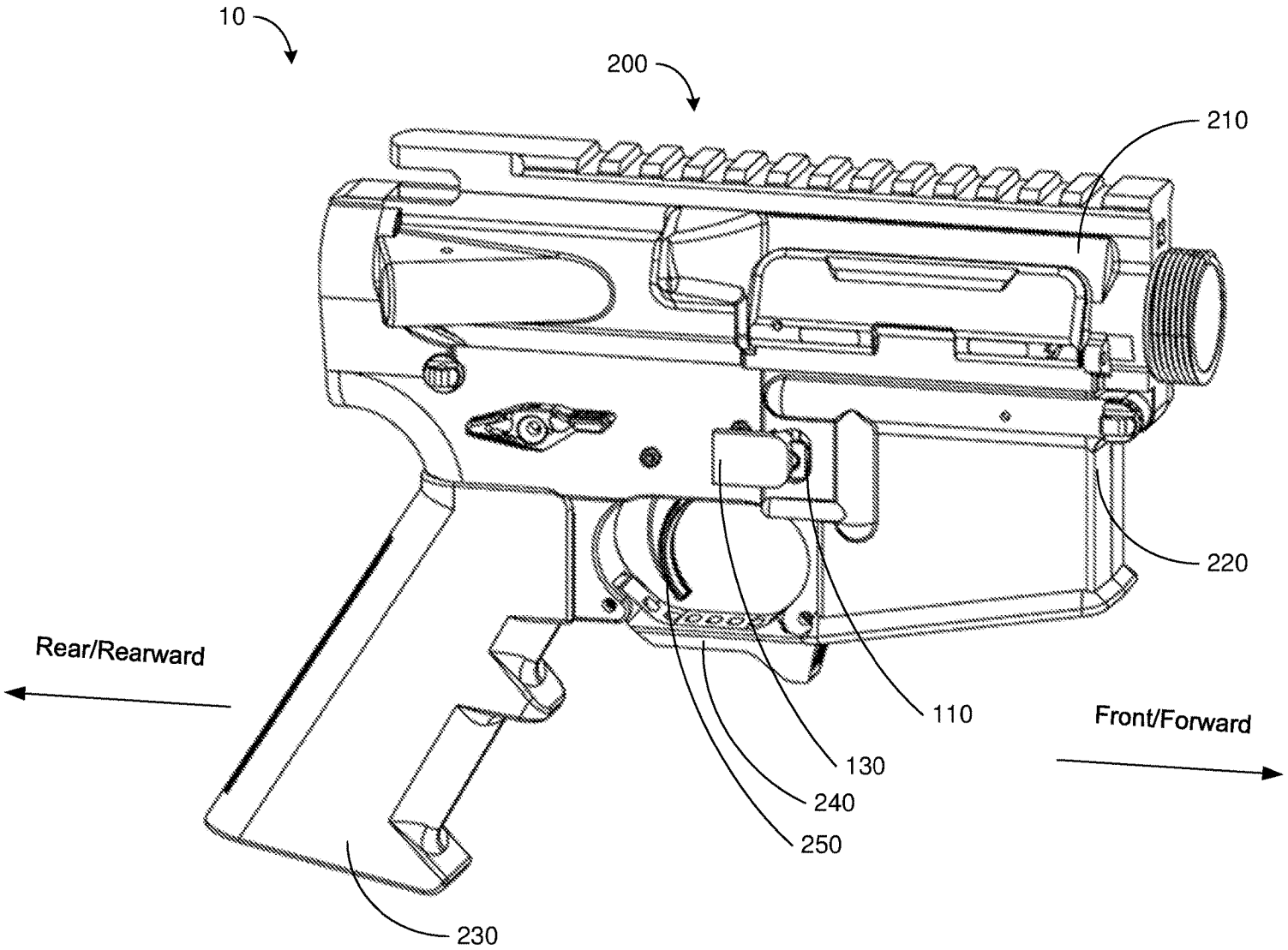
FIG. 4 is a diagram of an example implementation in accordance with an implementation of the present disclosure.
Figure 5:
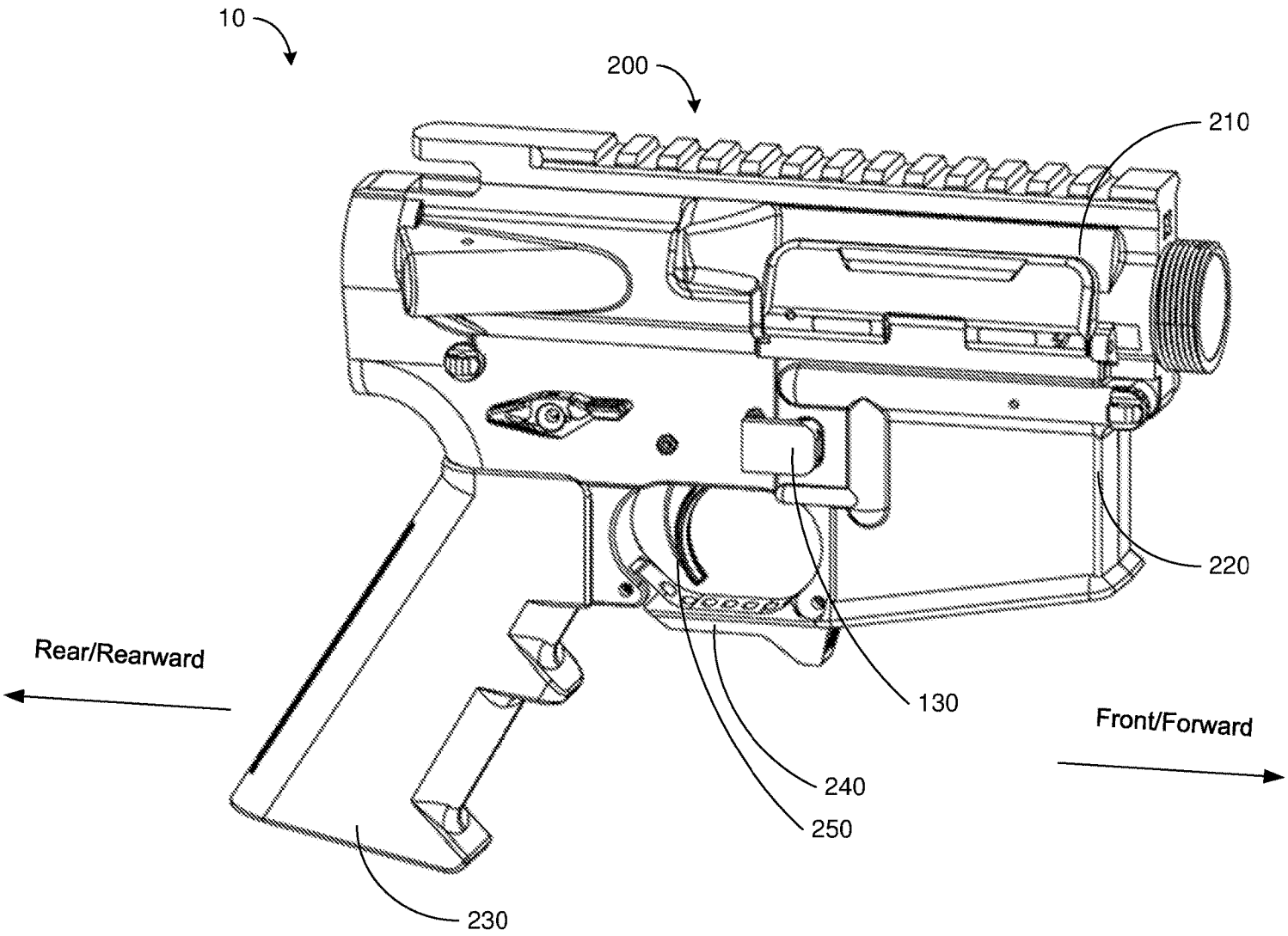
FIG. 5 is a diagram of an example implementation in accordance with an implementation of the present disclosure.

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

As used herein, the terms "proximal" and "proximally" may denote "forward" and "forwardly" with respect to the firearm, and the terms "distal" and "distally" may denote "rearward" and "rearwardly" with respect to the firearm. As used herein, the verb "to comprise" in this description, claims, and other conjugations are used in its non-limiting sense to mean those items following the word are included, but items not specifically mentioned are not excluded. As used herein, the word "forward" means moving in the direction that the projectile moves during firing a firearm. As used herein, the word "proximal" means closer to the reference point, in this case, the shooter. As used herein, the word "distal" means farther to the reference point, in this case, the shooter. Reference to an element by the indefinite article "a" or "an" does not exclude the possibility that more than one of the elements are present, unless the context clearly requires that there is one and only one of the elements. The indefinite article "a" or "an" thus usually means "at least one." Additionally, the words "a" and "an" when used in the present document in concert with the words "comprising" or "containing" denote "one or more.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure. The recitation of numerical ranges by endpoints includes all numbers within that range (e.g. 1 to 5 includes 1, 1.5, 2, 2.75, 3, 3.80, 4, and 5). All dimensions given herein are by way of examples to better illustrate the present disclosure embodiments and shall not be construed to limit the dimensions of the present disclosure embodiments to the given numeric values.

Overview

FIG. 1 illustrates a device 100 in accordance with an implementation of the present disclosure. Each of FIG. 2~FIG. 5 illustrates a respective step in an example implementation of device 100 in an apparatus 10 in accordance with the present disclosure. Apparatus 10 may include a firearm 200 and device 100 implemented or otherwise installed on firearm 200. Firearm 200 may be a firearm based on an AR platform (e.g., an AR15-styled or an AR10-styles rifle, carbine, pistol or shotgun). In the interest of brevity and without obscuring the figure, certain components (but not all) of firearm 200 are shown, while some other components are not shown, in FIG. 2~FIG. 5. Referring to FIG. 2~FIG. 5, firearm 200 may include, for example and without limitation, an upper receiver 210, a lower receiver 220, a pistol grip 230, a trigger guard 240, a trigger 250 and trigger mechanism (not shown), and device 100 which includes a modular magazine release in accordance with the present disclosure. Each of the upper receiver 210, pistol grip 230, trigger guard 240, trigger 250, and device 100 may be respectively attached to or otherwise installed on the lower receiver 220. Detailed description and an example implementation of device 100 are provided below with reference to FIG. 1~FIG. 5.

Referring to FIG. 1~FIG. 5, device 100 may include a magazine release button configured to be coupled to a magazine catch 140 of firearm 200. The magazine release button may include a coupler 110, a sleeve 120 and a detachable pedal 130. Coupler 110 may be configured to couple the magazine release button to magazine catch 140. For instance, a first end of coupler 110 (e.g., the bottom end shown in FIG. 1) may be configured to attach to magazine catch 140 and a second end of coupler 110 (e.g., the top end shown in FIG. 1) opposite the first end thereof may be configured to attach to detachable pedal 130. As shown in FIG. 1, coupler 110 may have a threaded through hole 115 into which a corresponding portion of magazine catch 140 may be screwed. Moreover, the second end of coupler 110 may be configured with ledges 112 on two opposite sides of the second end of coupler 110.

Under a proposed design, detachable pedal 130 may be slidingly attachable to coupler 110. As shown in FIG. 1, detachable pedal 130 may be slidingly attached to and detached from coupler 110 along a direction 138 which may be at an angle θ relative to an axis 105 of device 100. Axis 105 may be a longitudinal axis of device 100 along which magazine release button of device 100 (including coupler 110, sleeve 120 and detachable pedal 130) may move when detachable pedal 130 is pressed by a user (while device 100 is installed on firearm 200) to release a magazine from the magazine well of firearm 200. Angle θ may be in a range of 45°~135°. In some implementations, angle θ may be exactly or approximately 90°. Under the proposed design, detachable pedal 130 may have a first primary side (e.g., the top side shown in FIG. 1) and a second primary side (e.g., the bottom side shown in FIG. 1) opposite the first primary side. Moreover, the second primary side of detachable pedal 130 may have first and second protrusions 135 on two opposite ends thereof. Furthermore, the first and second protrusions may be configured with first and second grooves 132 thereon. Accordingly, when detachable pedal 130 is attached to coupler 110, the first primary side of detachable pedal 130 may be outward facing to be pressed by a user of apparatus 10 along axis 105 of device 100 while the second primary side of detachable pedal 130 may be coupled to the second end of coupler 110 with ledges 112 on the second end of coupler 110 received in first and second grooves 132 of first and second protrusions 135 on the second primary side of detachable pedal 130. That is, with ledges 112 and grooves 132, detachable pedal 130 may be slidingly attached to and detached from coupler 110 without the use of any tool (e.g., a screwdriver).

Under a proposed design, sleeve 120 may have a cavity 125 configured to receive coupler 110 therein, as shown in FIG. 1. For instance, coupler 110 may have a generally cylindrical profile toward the first end thereof and cavity 125 may be a cylindrically-shaped through hole to allow coupler 110 to slide one way or another (e.g., up and down as shown in FIG. 1) when coupler 110 is received in cavity 125 of sleeve 120. Under the proposed design, sleeve 120 may have a first end (e.g., the bottom end as shown in FIG. 1) and a second end (e.g., the top end as shown in FIG. 1) opposite the first end thereof. Accordingly, when the second primary side of detachable pedal 130 is coupled to the second end of coupler 110, the second primary side of detachable pedal 130 may interlock with the second end of sleeve 120.

Under a proposed design, as shown in FIG. 1, the second end of sleeve 120 may be configured with at least one tab on the second end of sleeve 120, such as two tabs 124 on two opposite sides of the second end of sleeve 120 for example. Correspondingly, first and second protrusions 135 on the second primary side of detachable pedal 130 may have at least one notch, such as two notches 134 for example. Accordingly, when the second primary side of detachable pedal 130 is coupled to the second end of coupler 110, tabs 124 on the second end of sleeve 120 may be received in notches 134 on first and second protrusions 135 on the second primary side of detachable pedal 130, thereby interlocking detachable pedal 130 and sleeve 120 to each other to secure detachable pedal 130 in place.

Under an alternative proposed design (not shown), the second end of sleeve 120 may be configured with at least one notch, such as two notches for example, on two opposite sides of the second end of sleeve 120. Correspondingly, at least one of first and second protrusions 135 on the second primary side of detachable pedal 130 may have at least one tab, such as two tabs for example. Accordingly, when the second primary side of detachable pedal 130 is coupled to the second end of coupler 110, the at least one tab on at least one of first and second protrusions 135 on the second primary side of detachable pedal 130 may be received in the at least one notch on the second end of sleeve 120, thereby interlocking detachable pedal 130 and sleeve 120 to each other to secure detachable pedal 130 in place.

Under a proposed design, device 100 may also include magazine catch 140. When the magazine release button and magazine catch 140 are installed on firearm 200, magazine catch 140 may be configured to hold a magazine (not shown) in a magazine well of firearm 200 when the magazine release button is not pressed. Moreover, magazine catch 140 may be configured to release the magazine from the magazine well when the magazine release button is pressed. Accordingly, when coupler 110 is received in cavity 125 of sleeve 120, magazine catch 140 may be attached to the first end of coupler 110 and detachable pedal 130 may be attached to the second end of coupler 110.

Under a proposed design, device 100 may also include a spring (not shown) disposed between magazine catch 140 and the magazine release button. The spring may be in contact with the first end of sleeve 120 but not in contact with coupler 110. That is, the spring may exert a force on sleeve 120 but not on coupler 110 (which maybe threaded onto magazine catch 140). In such cases, when sleeve 120 alone (but not coupler 110) is pressed against the spring along axis 105, sleeve 120 may move toward magazine catch 140 while coupler 110 remains relatively stationary. Accordingly, when attaching detachable pedal 130, a user may press down sleeve 120 (against the spring) along axis 105 and slide detachable pedal 130 over sleeve 120 with ledges 112 received in grooves 132. Then, the user may release sleeve 120 to allow tabs 124 to engage with notches 134. Similarly, when detaching detachable pedal 130, the user may press down sleeve 120 (against the spring) along axis 105 and slide detachable pedal 130 away from sleeve 120 before releasing sleeve 120.

Referring to FIG. 2~FIG. 5, when installing device 100 onto firearm 200, a user may first screw the threaded portion of magazine catch 140 into the threaded through hole 115 of coupler 110 while coupler 110 is received in cavity 125 of sleeve 120. Then, the user may slide detachable pedal 130 over sleeve 120 with ledges 112 received in grooves 132. The user may also press down sleeve 120 (against the spring) along axis 105 when sliding detachable pedal 130 over sleeve 120. When tabs 124 and notches 134 are aligned, the user may release sleeve 120 to allow tabs 124 to engage with notches 134, thereby interlocking detachable pedal 130 and sleeve 120 to each other to secure detachable pedal 130 in place.

It is noteworthy that the dimensions of various components of the proposed design may be adjusted to suit actual implementations. For instance, the overall size may be enlarged for implementation on a firearm of the AR10 platform (e.g., one chambered in 308 Winchester or 7.62×51 mm NATO). Similarly, the overall style may be changed. Likewise, the overall size may be reduced for implementation on a firearm of the AR15 platform (e.g., one chambered in 0.223 Remington or 5.56×54 mm NATO). It is further noteworthy that each component of the modular magazine release may be made of a suitable material (e.g., a suitable metal such as steel, aluminum or alloy) with appropriate mechanical properties such as sufficient strengths and/or hardness to withstand vibrations caused by firing of ammunition cartridges.

It is also noteworthy that, although examples shown and described in the present disclosure are provided in the context of a firearm based on the AR platform, device 100 (as well as any derivative and/or variation thereof) may be implemented on other types of firearms such as, for example and without limitation, rifles, carbines, shotguns and/or pistols that are not based on the AR platform.

It is further noteworthy that term "AR platform" herein refers to firearms based on the AR15 platform and the AR10 platform, as well as any variation and derivative thereof, and include AR15-styled and AR10-styled firearms, including rifles, carbines, pistols and shotguns. A firearm based on an AR platform may be chambered in one of a plethora of calibers. Some of the more popular calibers include such as, for example and without limitation, 0.223 Remington, 5.56×54 mm NATO, 0.224 Valkyrie, 300 AAC Blackout, 7.62×39 mm, 458 SOCOM, 6.5 mm Grendel, 6.8 mm Remington SPC, 308 Winchester and 7.62×51 mm NATO, just to name a few. Accordingly, the proposed design in accordance with the present disclosure may be implemented in any firearm based on the AR platform (whether the AR15 platform or the AR10 platform), as well as any variation and derivative thereof, in any suitable caliber.

Example Implementations

In view of the above, the proposed design of an integrated shell deflector forward assist may be implemented in many ways. For illustrative purposes and without limiting the scope of the present disclosure, a few example implementations of the proposed design are described below.

In one aspect, a device implementable on a firearm based on an AR platform (e.g., AR15 platform or AR10 platform) may include a magazine release button configured to be coupled to a magazine catch of the firearm. The magazine release button may include a coupler configured to couple the magazine release button to the magazine catch. The magazine release button may also include a detachable pedal slidingly attachable to the coupler.

In some implementations, a first end of the coupler may be configured to attach to the magazine catch and a second end of the coupler opposite the first end thereof may be configured to attach to the detachable pedal. In such cases, the second end of the coupler may be configured with ledges on two opposite sides thereof.

In some implementations, the detachable pedal may have a first primary side and a second primary side opposite the first primary side. Moreover, the second primary side may have a first protrusion and a second protrusion on two opposite ends thereof. Furthermore, the first protrusion may be configured with a first groove and the second protrusion may be configured with a second groove.

In some implementations, when the detachable pedal is attached to the coupler, the first primary side may be outward facing to be pressed by a user and the second primary side may be coupled to the second end of the coupler with the ledges on the second end of the coupler received in the first and second grooves of the first and second protrusions on the second primary side of the detachable pedal.

In some implementations, the magazine release button may also include a sleeve. In such cases, the sleeve may have a cavity configured to receive the coupler therein.

In some implementations, the sleeve may have a first end and a second end opposite the first end thereof. In such cases, when the second primary side of the detachable pedal is coupled to the second end of the coupler, the second primary side of the detachable pedal may interlock with the second end of the sleeve.

In some implementations, the second end of the sleeve may be configured with at least one tab on the second end. Correspondingly, at least one of the first and second protrusions on the second primary side of the detachable pedal may have at least one notch. In such cases, when the second primary side of the detachable pedal is coupled to the second end of the coupler, the at least one tab on the second end of the sleeve may be received in the at least one notch on at least one of the first and second protrusions on the second primary side of the detachable pedal.

Alternatively, the second end of the sleeve may be configured with at least one notch on the second end. Correspondingly, at least one of the first and second protrusions on the second primary side of the detachable pedal may have at least one tab. In such cases, when the second primary side of the detachable pedal is coupled to the second end of the coupler, the at least one tab on at least one of the first and second protrusions on the second primary side of the detachable pedal may be received in the at least one notch on the second end of the sleeve.

In some implementations, the device may also include the magazine catch. When the magazine release button and the magazine catch are installed on the firearm, the magazine catch may be configured to hold a magazine in a magazine well of the firearm when the magazine release button is not pressed. Moreover, the magazine catch may be configured to release the magazine from the magazine well when the magazine release button is pressed.

In some implementations, when the coupler is received in the cavity of the sleeve, the magazine catch may be attached to the first end of the coupler and the detachable pedal is attached to the second end of the coupler.

In some implementations, the magazine release may also include a spring disposed between the magazine catch and the magazine release button.

In some implementations, the spring may be in contact with the first end of the sleeve but not in contact with the coupler. In such cases, when the sleeve alone is pressed against the spring, the sleeve may move toward the magazine catch while the coupler remains stationary.

In another aspect, a device implementable on a firearm based on an AR platform (e.g., AR15 platform or AR10 platform) may include a magazine release. The magazine release may include a magazine catch and a magazine release button coupled to the magazine catch. When the magazine release is installed on the firearm, the magazine catch may be configured to hold a magazine in a magazine well of the firearm when the magazine release button is not pressed. Moreover, the magazine catch may be configured to release the magazine from the magazine well when the magazine release button is pressed. The magazine release button may include a coupler configured to couple the magazine release button to the magazine catch. The magazine release button may also include a detachable pedal slidingly attachable to the coupler.

In some implementations, a first end of the coupler may be configured to attach to the magazine catch and a second end of the coupler opposite the first end thereof may be configured to attach to the detachable pedal. In such cases, the second end of the coupler may be configured with ledges on two opposite sides thereof.

In some implementations, the detachable pedal may have a first primary side and a second primary side opposite the first primary side. Additionally, the second primary side may have a first protrusion and a second protrusion on two opposite ends thereof. Moreover, the first protrusion may be configured with a first groove and the second protrusion may be configured with a second groove. In such cases, when the detachable pedal is attached to the coupler, the first primary side may be outward facing to be pressed by a user and the second primary side may be coupled to the second end of the coupler with the ledges on the second end of the coupler received in the first and second grooves of the first and second protrusions on the second primary side of the detachable pedal.

In some implementations, the magazine release button may also include a sleeve. The sleeve may have a cavity configured to receive the coupler therein. In such cases, when the coupler is received in the cavity of the sleeve, the magazine catch may be attached to the first end of the coupler and the detachable pedal may be attached to the second end of the coupler.

In some implementations, the magazine release may also include a spring disposed between the magazine catch and the magazine release button.

In some implementations, the sleeve may have a first end and a second end opposite the first end thereof. In such cases, the spring may be in contact with the first end of the sleeve but not in contact with the coupler. Moreover, when the sleeve alone is pressed against the spring, the sleeve may move toward the magazine catch while the coupler remains stationary.

In some implementations, when the second primary side of the detachable pedal is coupled to the second end of the coupler, the second primary side of the detachable pedal may interlock with the second end of the sleeve.

In some implementations, the second end of the sleeve may be configured with at least one tab on the second end. Correspondingly, at least one of the first and second protrusions on the second primary side of the detachable pedal may have at least one notch. In such cases, when the second primary side of the detachable pedal is coupled to the second end of the coupler, the at least one tab on the second end of the sleeve may be received in the at least one notch on at least one of the first and second protrusions on the second primary side of the detachable pedal.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A device implementable on a firearm, comprising:

a magazine release button configured to be coupled to a magazine catch of the firearm, the magazine release button comprising:

a coupler configured to couple the magazine release button to the magazine catch; and a detachable pedal slidingly attachable to the coupler, wherein a first end of the coupler is configured to attach to the magazine catch and a second end of the coupler opposite the first end thereof is configured to attach to the detachable pedal, wherein the second end of the coupler is configured with ledges on two opposite sides thereof, wherein the detachable pedal has a first primary side and a second primary side opposite the first primary side, wherein the second primary side has a first protrusion and a second protrusion on two opposite ends thereof, wherein the first protrusion is configured with a first groove and the second protrusion is configured with a second groove, wherein, when the detachable pedal is attached to the coupler, the first primary side is outward facing to be pressed by a user and the second primary side is coupled to the second end of the coupler with the ledges on the second end of the coupler received in the first and second grooves of the first and second protrusions on the second primary side of the detachable pedal, wherein the magazine release button further comprises a sleeve, wherein the sleeve has a cavity configured to receive the coupler therein, wherein the sleeve has a first end and a second end opposite the first end thereof, and wherein, when the second primary side of the detachable pedal is coupled to the second end of the coupler, the second primary side of the detachable pedal interlocks with the second end of the sleeve.

2. The device of claim 1, wherein the second end of the sleeve is configured with at least one tab on the second end, wherein at least one of the first and second protrusions on the second primary side of the detachable pedal have at least one notch, and wherein, when the second primary side of the detachable pedal is coupled to the second end of the coupler, the at least one tab on the second end of the sleeve is received in the at least one notch on at least one of the first and second protrusions on the second primary side of the detachable pedal.

3. The device of claim 1, wherein the second end of the sleeve is configured with at least one notch on the second end, wherein at least one of the first and second protrusions on the second primary side of the detachable pedal has at least one tab, and wherein, when the second primary side of the detachable pedal is coupled to the second end of the coupler, the at least one tab on at least one of the first and second protrusions on the second primary side of the detachable pedal is received in the at least one notch on the second end of the sleeve.

4. The device of claim 1, further comprising:

the magazine catch, wherein, when the magazine release button and the magazine catch are installed on the firearm:

the magazine catch is configured to hold a magazine in a magazine well of the firearm when the magazine release button is not pressed, and the magazine catch is configured to release the magazine from the magazine well when the magazine release button is pressed.

5. The device of claim 4, wherein, when the coupler is received in the cavity of the sleeve, the magazine catch is attached to the first end of the coupler and the detachable pedal is attached the second end of the coupler.

6. The device of claim 5, wherein the magazine release further comprises a spring disposed between the magazine catch and the magazine release button.

7. The device of claim 6, wherein the spring is in contact with the first end of the sleeve but not in contact with the coupler, and wherein, when the sleeve alone is pressed against the spring, the sleeve moves toward the magazine catch while the coupler remains stationary.

8. A device implementable on a firearm, comprising:

a magazine release comprising:

a magazine catch; and a magazine release button coupled to the magazine catch, wherein, when the magazine release is installed on the firearm:

the magazine catch is configured to hold a magazine in a magazine well of the firearm when the magazine release button is not pressed, and the magazine catch is configured to release the magazine from the magazine well when the magazine release button is pressed, wherein the magazine release button comprises:

a coupler configured to couple the magazine release button to the magazine catch; and a detachable pedal slidingly attachable to the coupler, wherein a first end of the coupler is configured to attach to the magazine catch and a second end of the coupler opposite the first end thereof is configured to attach to the detachable pedal, wherein the second end of the coupler is configured with ledges on two opposite sides thereof, wherein the detachable pedal has a first primary side and a second primary side opposite the first primary side, wherein the second primary side has a first protrusion and a second protrusion on two opposite ends thereof, wherein the first protrusion is configured with a first groove and the second protrusion is configured with a second groove, wherein, when the detachable pedal is attached to the coupler, the first primary side is outward facing to be pressed by a user and the second primary side is coupled to the second end of the coupler with the ledges on the second end of the coupler received in the first and second grooves of the first and second protrusions on the second primary side of the detachable pedal, wherein the magazine release button further comprises a sleeve, wherein the sleeve has a cavity configured to receive the coupler therein, wherein, when the coupler is received in the cavity of the sleeve, the magazine catch is attached to the first end of the coupler and the detachable pedal is attached to the second end of the coupler, wherein the magazine release further comprises a spring disposed between the magazine catch and the magazine release button, wherein the sleeve has a first end and a second end opposite the first end thereof, wherein the spring is in contact with the first end of the sleeve but not in contact with the coupler, wherein, when the sleeve alone is pressed against the spring, the sleeve moves toward the magazine catch while the coupler remains stationary, and wherein, when the second primary side of the detachable pedal is coupled to the second end of the coupler, the second primary side of the detachable pedal interlocks with the second end of the sleeve.

9. The device of claim 8, wherein the second end of the sleeve is configured with at least one tab on the second end, wherein at least one of the first and second protrusions on the second primary side of the detachable pedal has at least one notch, and wherein, when the second primary side of the detachable pedal is coupled to the second end of the coupler, the at least one tab on the second end of the sleeve is received in the at least one notch on at least one of the first and second protrusions on the second primary side of the detachable pedal.

* * * * *